US006375305B2

(12) United States Patent
Sugimoto et al.

(10) Patent No.: US 6,375,305 B2
(45) **Date of Patent: *Apr. 23, 2002**

(54) WASTE INK TANK AND INK JET RECORDING APPARATUS

(75) Inventors: Hitoshi Sugimoto, Yokohama; Makoto Kawarama, Kawasaki, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/422,104

(22) Filed: Oct. 20, 1999

(30) Foreign Application Priority Data

Oct. 27, 1998 (JP) ..... 10-304955

(51) Int. Cl.[7] ..... B41J 2/165
(52) U.S. Cl. ..... 347/36; 347/86
(58) Field of Search ..... 347/36, 86, 87, 347/30, 31

(56) References Cited

U.S. PATENT DOCUMENTS

| | | | | |
|---|---|---|---|---|
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,216,450 A | | 6/1993 | Koitabashi et al. | 347/87 |
| 5,557,310 A | | 9/1996 | Kurata et al. | 347/87 |
| 5,847,736 A | * | 12/1998 | Kanbayashi et al. | 347/89 |

FOREIGN PATENT DOCUMENTS

| | | | | |
|---|---|---|---|---|
| JP | 06-198913 | | 5/1979 | |
| JP | 54-056847 | | 5/1979 | |
| JP | 59-123670 | | 7/1984 | |
| JP | 59-138461 | | 8/1984 | |
| JP | 60-071260 | | 4/1985 | |
| JP | 03227658 | * | 10/1991 | 347/36 |
| JP | 07-251509 | | 10/1995 | |
| JP | 08-112914 | | 5/1996 | |
| JP | 408238782 A | * | 9/1996 | 347/36 |

* cited by examiner

*Primary Examiner*—N. Le
*Assistant Examiner*—Shih-wen Hsieh
(74) *Attorney, Agent, or Firm*—Fitzpatrick, Cella, Harper & Scinto

(57) ABSTRACT

A slit extending from a waste ink inlet position (indicated by a cross mark) in one direction is formed in a waste ink absorber of the waste ink tank. Thereby, the leakage of waste ink from a waste ink storage is avoidable by the improvement in the waste ink absorbing performance through a simple and inexpensive constitution.

16 Claims, 8 Drawing Sheets

WASTE INK TANK AND INK JET RECORDING APPARATUS

This application is based on patent application Ser. No. 10-304955 filed Oct. 27, 1998 in Japan, the content of which is incorporated hereinto by reference.

BACKGROUND OF THE INVENTION

1. Field of the Invention

The present invention relates to a tank for waste ink not contributing to the image recording and relates to an ink jet recording apparatus.

2. Description of the Related Art

The ink jet recording method has been widely used for a printing apparatus or a copying apparatus because it is low in noise and inexpensive in running cost as well as the apparatus can be easily minimized in size and adapted for a color system.

There is an ink jet recording apparatus having a pump for compulsively ejecting ink from a plurality of ink ejection orifices of a recording head. Such a pump is made to operate when the orifice is clogged with ink which is thickened and solidified in the orifice due to the evaporation and/or dry to cause the deflection (from the target direction) or the interruption of the ink jet, or when foreign matters adhere to the orifice to result in the erroneous ink jet, or when bubbles dwell in an ink feeding path from an ink tank to the orifice of the recording head, so that the thickened and solidified ink, the foreign matters or the bubbles are compulsively discharged from the orifice by the action of the pump to recover the ink head to the normal ink jet operation. In general, the ink jet apparatus with a mechanism using such a pump for compulsively discharging the ink from the orifice has a waste ink storage for storing the waste ink thus discharged.

There has been a waste ink storage in the prior art wherein a waste ink absorber is accommodated therein for absorbing and retaining the ink so that the waste ink discharged from the pump is absorbed in the waste ink absorber. According to this waste ink storage, the waste ink absorber is not accommodated within a sealed container but vents or the like are provided to facilitate the evaporation and dry of the waste ink so that as much the ink as possible could be absorbed in the waste ink absorber. The waste ink storage of this type is required to quickly absorb the ink in the waste ink absorber as well as to prevent the waste ink once absorbed therein from leaking from the waste ink absorber. Also, to effectively use the waste ink absorber, it is necessary for the ink to be absorbed throughout the waste ink absorber.

For the purpose of satisfying such demands, a waste ink storage has been proposed wherein a combination of a waste ink absorber having a high ink absorbing rate with that having a high ink retaining capacity is used, or a waste ink absorber with a density gradient so that the farther the distance from a waste ink inlet position, the higher the density thereof is used (see Japanese Patent Application Laid-open No. 6-198913 (1994)). Alternatively, a waste ink storage has been proposed wherein grooves are provided in the inner wall of an ink tank brought into contact with an ink absorber (see Japanese Patent Application Laid-open No. 8-112914 (1996)).

Recently, the resistance to water or the resistance to light of the recorded image obtained by the ink jet recording system is also required, and the improvement of ink has been done for this purpose. For example, various inks have been used, such as one which becomes insoluble to water after dried or one using pigment as a colorant. Some of these inks become considerably viscous to lose the fluidity (for example, due to the gelation) when evaporated and dried.

The prior art waste ink absorber has the following problems when such inks are absorbed therein:

That is, in the ink jet recording apparatus, the ink is not frequently discharged from the orifices of the printing head by the pump and the waste ink is absorbed in the waste ink absorber at a very low rate while requiring a long time period. In such a case, the waste ink tends to evaporate to be highly viscous and lose the fluidity in the vicinity of the inlet position of the waste ink absorber, resulting in the clogging of the waste ink absorber.

Therefore, even if the waste ink absorber has a capacity capable of absorbing all the waste ink possibly generating during the product life of the recording apparatus, there might be a problem in that the waste ink overflows from the waste ink storage before the waste ink has diffused to the entirety of waste ink absorber if a portion of the waste ink absorber loses the absorbency in the vicinity of the waste ink inlet position. According to Japanese Patent Application Laid-open No. 8-112914 (1996), for instance, a distance between grooves provided in the inner wall of an ink tank and the waste ink absorber is narrow. This causes a problem that clogging of the waste ink absorber easily occurs due to the waste ink, thereby failing to achieve required product life in some case.

The present invention has been made to solve the above-mentioned technical problems in the prior art, and an object thereof is to provide a waste ink tank and an ink jet recording apparatus capable of avoiding the leakage of waste ink from a waste ink storage by the improvement in the waste ink absorbing performance thereof through a simple and inexpensive constitution.

SUMMARY OF THE INVENTION

A waste ink tank according to the present invention for introducing waste ink not contributing to the image recording thereinto and absorbing/retaining the waste ink in a waste ink absorber is characterized in that a recess is formed in the waste ink absorber and extends to include an inlet position for the waste ink.

An ink jet recording apparatus according to the present invention for recording an image on a recording medium by using an ink jet recording head from which ink droplets are ejectable is characterized in that the apparatus comprises a waste ink tank having a recess and a recovery means for discharging ink not contributing to the image recording from the ink jet recording head as waste ink.

As described above, according to the present invention, since the recess in a slit form or others is provided in the waste ink absorber to introduce waste ink thereinto, it is possible for the ink to diffuse via the recess even if the waste ink absorber partially loses its absorbency due to viscous ink, and consequently for the entirety of the waste ink absorber to be effectively used. Thus, the waste ink absorbency is improved by an extremely simple and inexpensive constitution.

The above and other objects, effects, features and advantages of the present invention will become more apparent from the following description of embodiments thereof taken in conjunction with the accompanying drawings.

DESCRIPTION OF THE PREFERRED EMBODIMENTS

The present invention will be described in more detail below with reference to the preferred embodiments illustrated in the attached drawings.

Figure 1:
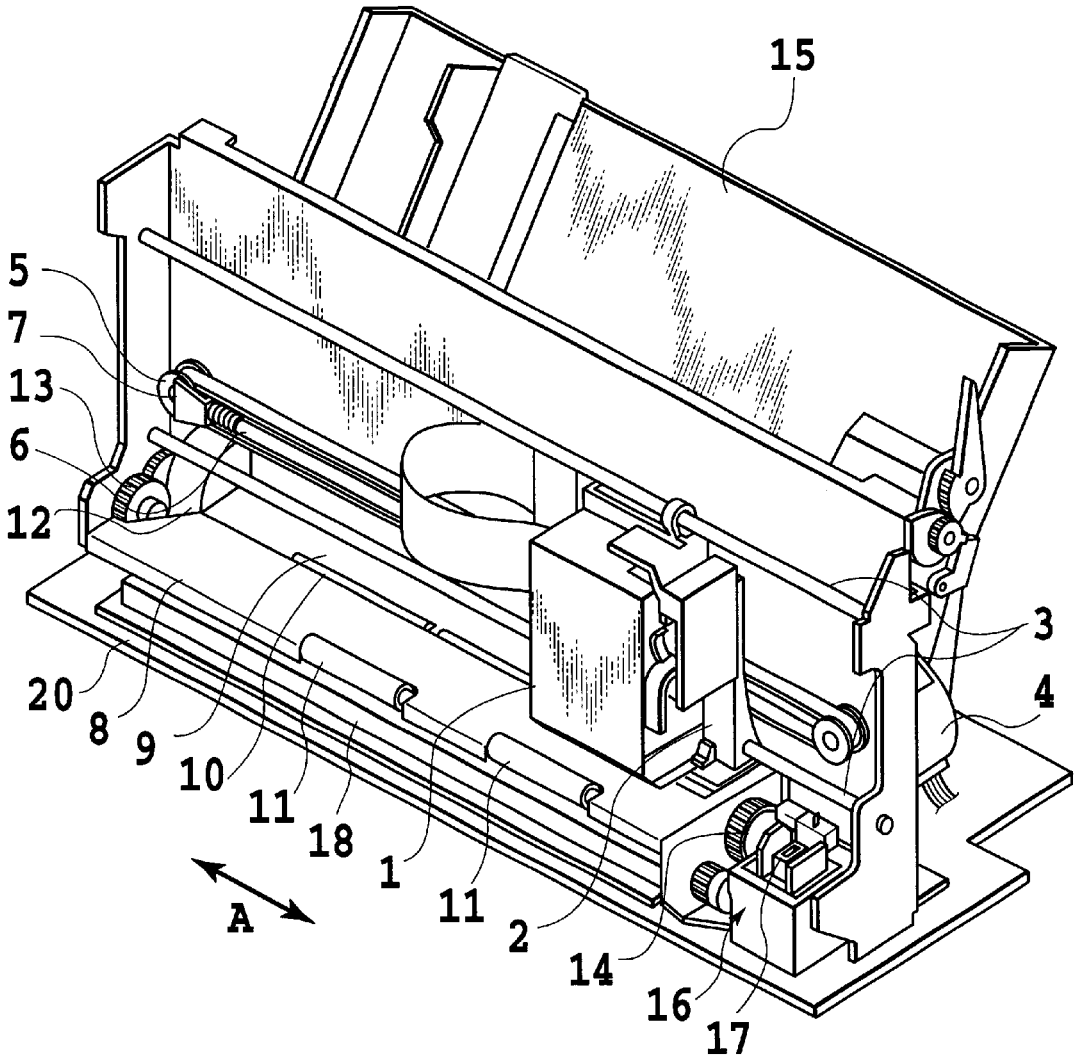
FIG. 1 is an overall diagrammatic perspective view of an ink jet recording apparatus according to the present invention.

FIG. 1 is an overall diagrammatic perspective view of an ink jet recording apparatus. With reference to FIG. 1, an ink jet recording head 1 used as a recording means is carried on a carriage 2 which is guided and supported by two guide rails 3 provided in a body of the apparatus to be movable in reciprocation in a primary scanning direction shown by an arrow A. At one end of the apparatus body, a carriage motor 4 is mounted for displacing the carriage 2. At the other end of the apparatus body, an idler pulley 5 is disposed.

A timing belt 6 is provided in a tensioned state between the carriage motor 4 and the idler pulley 5 in parallel to the guide rails 3, and part of the timing belt 6 is connected to the carriage 2. A predetermined tension is applied to the timing belt 6 by a tension spring 7 provided in the vicinity of the idler pulley 5. The normal and reverse rotations of the carriage motor 4 cause the carriage 2 to be subjected to a reciprocating motion while controlling a position of the carriage 2; i.e., a position of the recording head 1; in accordance with a rotation of the carriage motor 4.

A platen 8 is provided at a position opposed to ink orifices of the recording head 1 in parallel to the guide rails 3. The platen 8 is used for restricting a position of a print medium (such as a recording paper sheet or others) in a recording zone. Upstream from the platen 8 as seen in the paper-sheet running direction, a feed roller (not shown) is disposed in parallel to the guide rails 3. A pinch roller 10 held by a pinch roller guide 9 is brought into press contact with this feed roller to deliver the print medium fed from an automatic paper-sheet feeder 15 onto the platen 8 in the recording zone. Downstream from the platen as seen in the paper-sheet running direction, a delivery roller 11 and a spur (not shown) are provided to forward the print medium passing through the recording zone in an auxiliary scanning direction transverse to the primary scanning direction shown by the arrow A by a frictional force between the discharging roller and the spur.

At a position outside a recording operation area defined on the right side of the platen 8, a recovery device 16 is disposed. A cap 17 is provided in the recovery device 16, capable of sealing ink orifices of the recording head 1. The recovery device 16 is adapted to generate a negative pressure within the interior of the cap 17 sealing the ink orifices of the recording head 1 by the action of a suction pump or the like to suck thickened or solidified ink out of the ink orifice so that the ink ejection performance of the recording head 1 is recovered. The cap 17 is not only used as means for sucking ink from the recording head 1 during the recovery operation as described above but also used for preventing the ink in the orifice from drying when the recording apparatus is being transported or the recording head 1 is in a non-operative state.

The automatic paper sheet feeder 15, the feed roller (not shown), the delivery roller 11, the recovery device 16 or others are driven by an LF (line feed) motor 12 used as a drive source via a transmission mechanism comprised of gear trains 13, 14, a clutch (not shown) or others. In this embodiment, although a single recording head 1 is mounted to the carriage 2, it is noted that the present invention should not be limited thereto but is applicable to a color ink jet recording apparatus wherein a plurality of recording heads 2 are mounted to a carriage 2.

The recording head (recording means) 1 is of an ink jet type provided with an electrothermal transducer, wherein ink is ejected by the use of heat energy.

Figure 2:
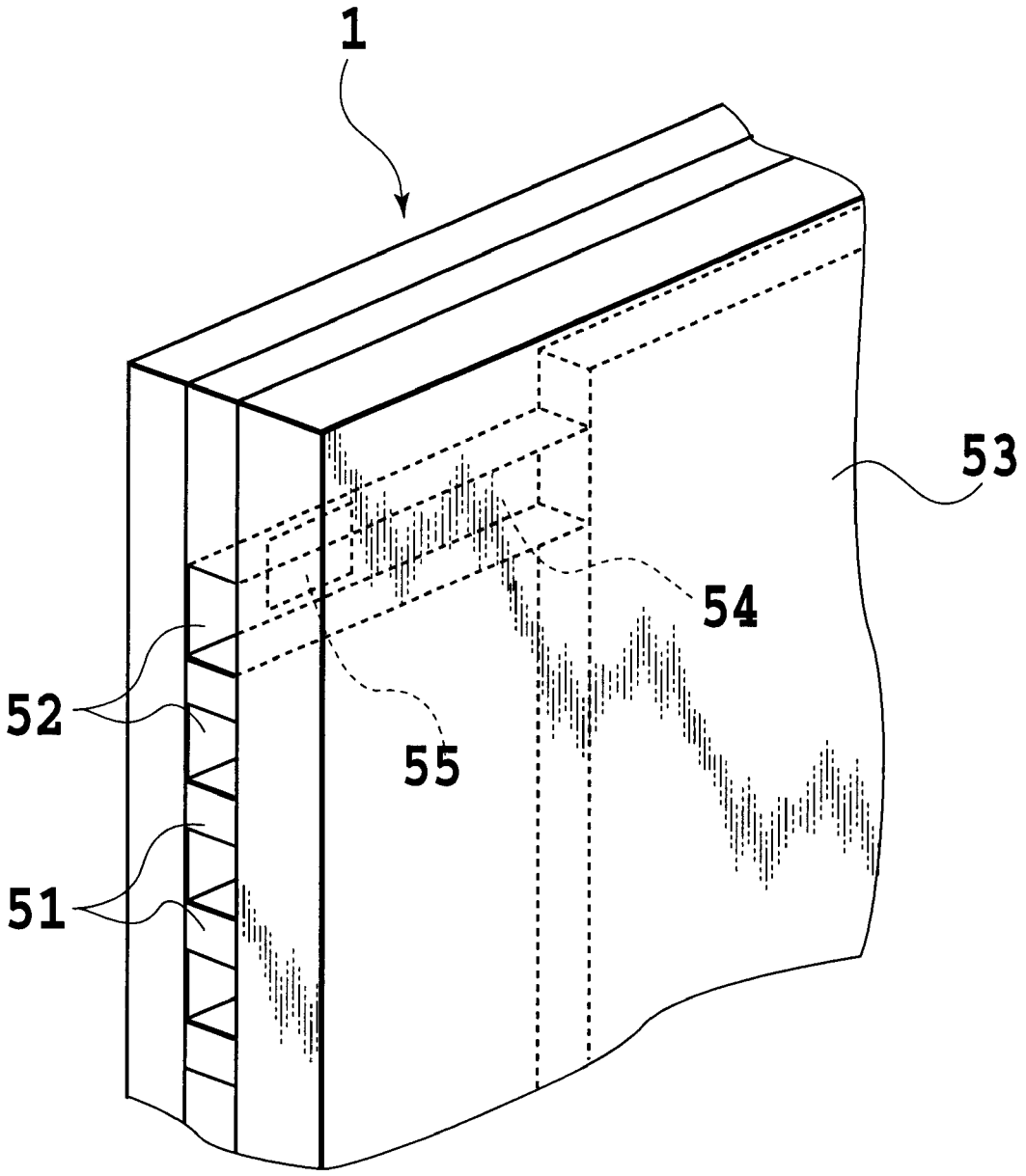
FIG. 2 is a perspective view of an ink ejection portion of a recording head of the apparatus shown in FIG. 1.

FIG. 2 is a perspective view illustrating part of an ink ejection portion of the recording head 1 of this embodiment. In FIG. 2, a plurality of ink ejection orifices 52 are formed at a predetermined pitch on an orifice-forming surface 51 opposed to the print medium at a predetermined distance (for example, in a range from approximately 0.5 to 2.0 mm), and an electrothermal transducer (such as a heat generation resistor) 55 for generating energy necessary for the ink ejection is provided along a wall surface of each of liquid paths 54, communicating a common liquid chamber 53 with the respective orifices 52. The recording head 1 of this embodiment is mounted to the carriage 2 in the positional relationship wherein rows of the orifices 52 are arranged in the direction transverse to the primary scanning direction. The recording head 1 generates the heat energy in the electrothermal transducer 55 by the application of a drive signal thereto, whereby the ink in the liquid path 54 is subjected to the film boiling to generate bubbles which cause the pressure variation due to the expansion/contraction thereof to eject ink droplets from the orifices 52 for the purpose of recording.

Figure 3:
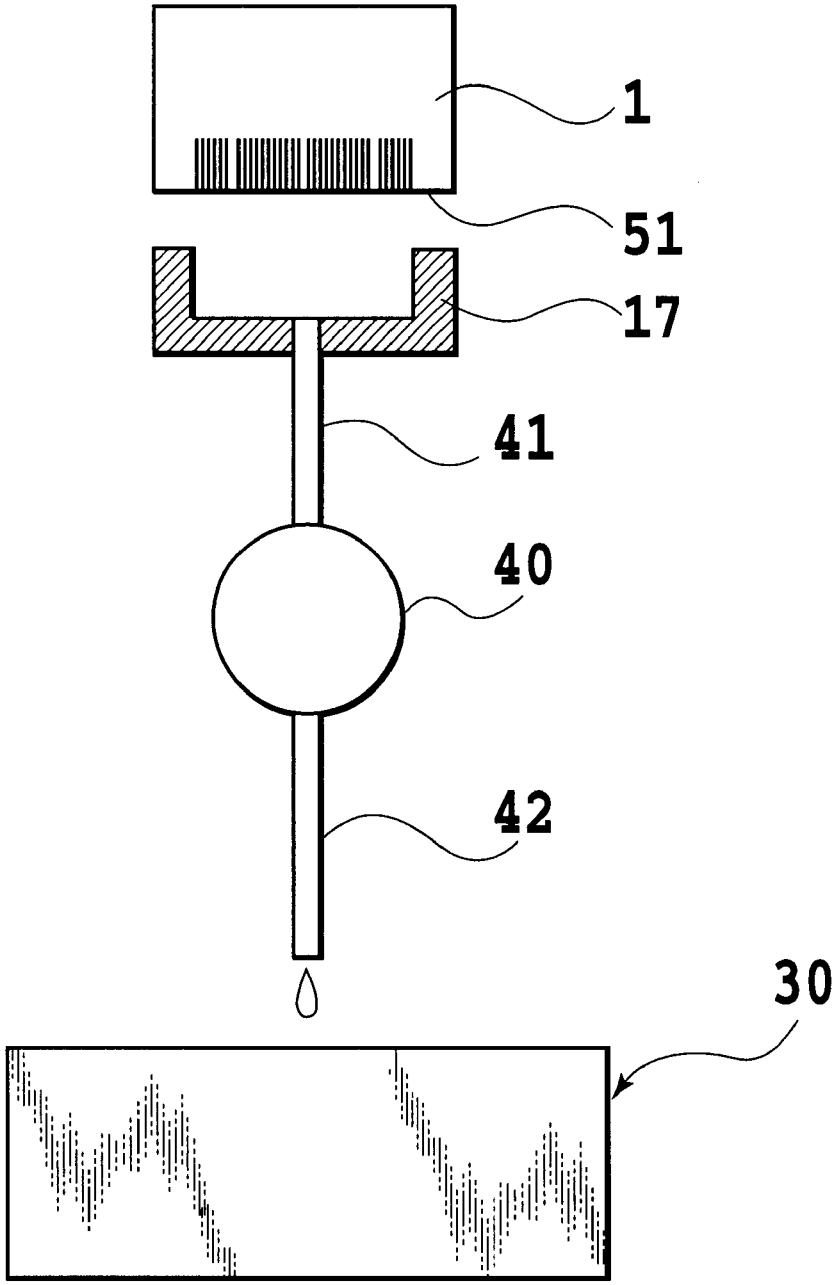
FIG. 3 is a diagrammatic view illustrating a constitution of a recovery device shown in FIG. 1.

FIG. 3 is a diagrammatic view illustrating a constitution of the recovery device 16 for explaining the flow of waste ink during the recovery operation of the recording head 1. The orifice-forming surface 51 of the recording head 1 is covered with the cap 17, to which is connected, via a waste ink supply path 41 communicating with the cap 17, a suction pump 40, from which the ink is sucked from the orifice 52 (see FIG. 2). The waste ink thus sucked is discharged into a waste ink tank 30 through another waste ink supply path 42 connected to the suction pump 40.

Figure 4A:
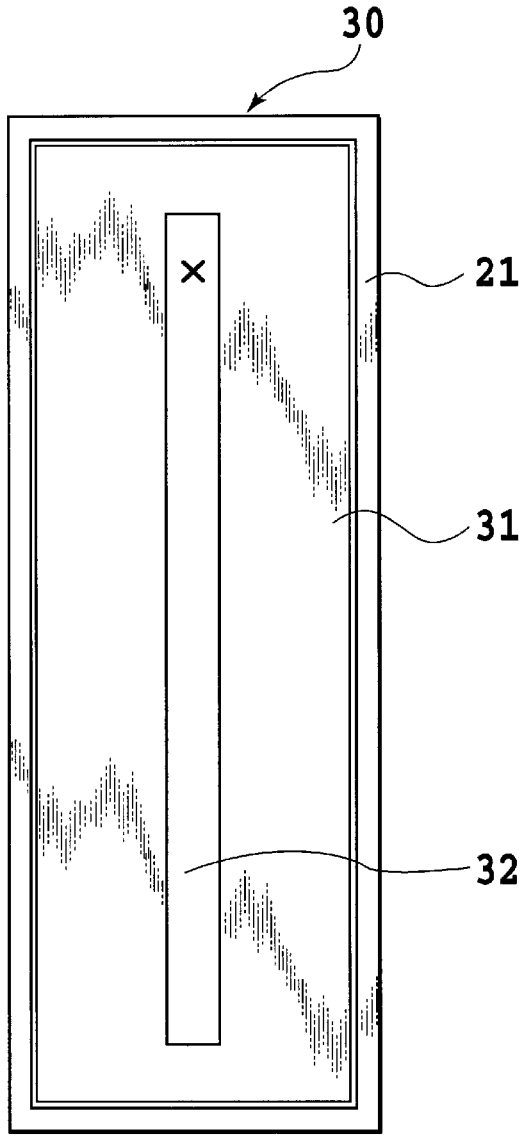
FIG. 4A is a plan view of a waste ink tank according to the first embodiment of the present invention.
Figure 4B:
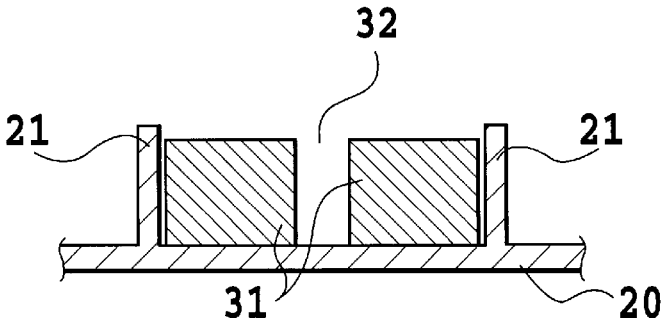
FIG. 4B is a sectional view of this waste ink tank.

FIG. 4A is a plan view of the waste ink tank 30 in this embodiment, and FIG. 4B is a sectional view of the waste ink tank 30. The waste ink tank 30 in this embodiment is installed on a base 20 supporting the recording apparatus, and has partitioning walls 21 on four sides for forming a waste ink container body. A waste ink absorber 31 for absorbing and retaining waste ink is accommodated in a space defined by the partitioning walls 21. The base 20 and the partitioning walls 21 form a so-called top-opening tank case in which is accommodated the waste ink absorber 31.

The waste ink absorber 31 may be made of any kinds of material provided they are capable of absorbing and retaining ink; examples thereof being porous absorber such as sponge and fibrous absorber such as felt or laminated paper. The waste ink absorber 31 is provided with a slit 32 formed as a recess extending in place including a position indicated by a cross mark (x) in FIG. 4A at which the waste ink discharged from the suction pump 40 is introduced into the waste ink absorber through the waste ink supply path 42. As shown in FIG.4B, the slit 32 is formed so as to pass through the waste ink absorber 31 in the depth direction and thereby to make the base 20 exposed partially.

The waste ink thus introduced falls down onto the part of cross mark (x) on the base 20 and when the ink is brought into contact with the waste ink absorber 31 in the vicinity of the cross mark, it is absorbed due to a capillary action of the absorber. As the absorption and evaporation/drying of a small amount of the waste ink are repeated, the waste ink in the absorber 31 in the vicinity of the cross mark is thickened by the evaporation to lose the fluidity in the interior of the waste ink absorber 31, whereby the absorber 31 is clogged therewith to degrade the ink absorbency. If the discharge of waste ink continues under such circumstances, the waste ink not absorbed in the vicinity of the cross mark displaces through the part of base 20 exposed under the slit 32 to a fresh portion of the absorber 31 extending apart from the cross mark and maintaining a high ink absorbency.

As described above, according to this embodiment, it is possible to absorb the waste ink substantially all over the waste ink absorber 31 by a simple and inexpensive structure without increasing the number of parts.

Figure 5A:
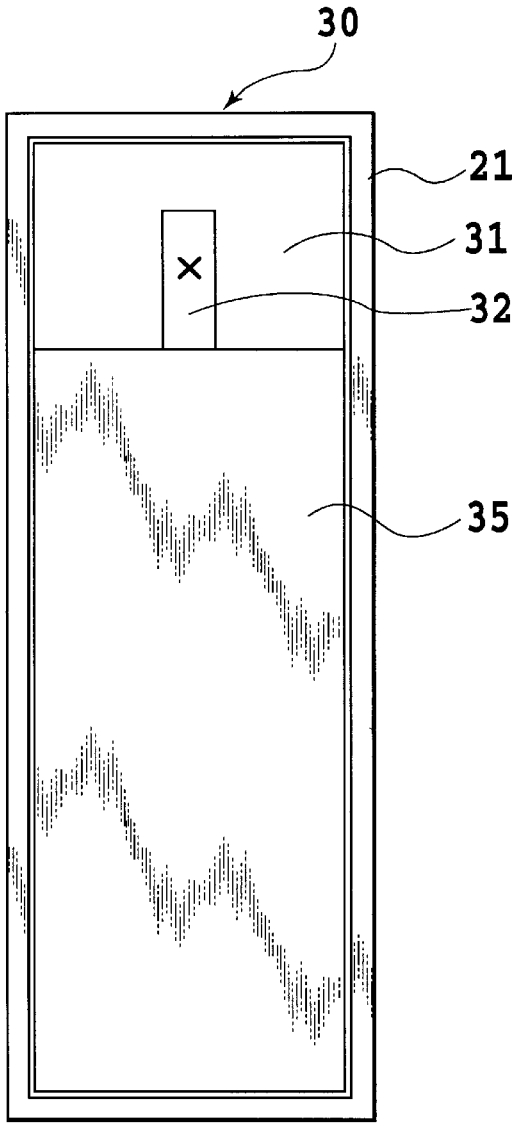
FIG. 5A is a plan view of another waste ink tank according to the first embodiment of the present invention.
Figure 5B:
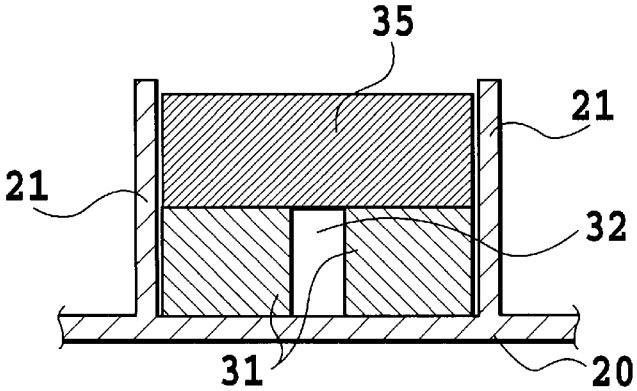
FIG. 5B is a sectional view of this waste ink tank.

As shown in FIGS. 5A and 5B, another waste ink absorber 35 may be laid on the waste ink absorber 31 provided with the slit 32 to increase the ink absorbing capacity. In such a case, the waste ink absorber 35 is laid so that a portion of the previous waste ink absorber 31 including the inlet position indicated by the cross mark at which the waste ink is introduced is open, as shown in FIG. 5A. In other words, a opening of the slit 32 is covered with another waste ink absorber 35 except for at least the waste-ink inlet position.

Second Embodiment

Figure 6:
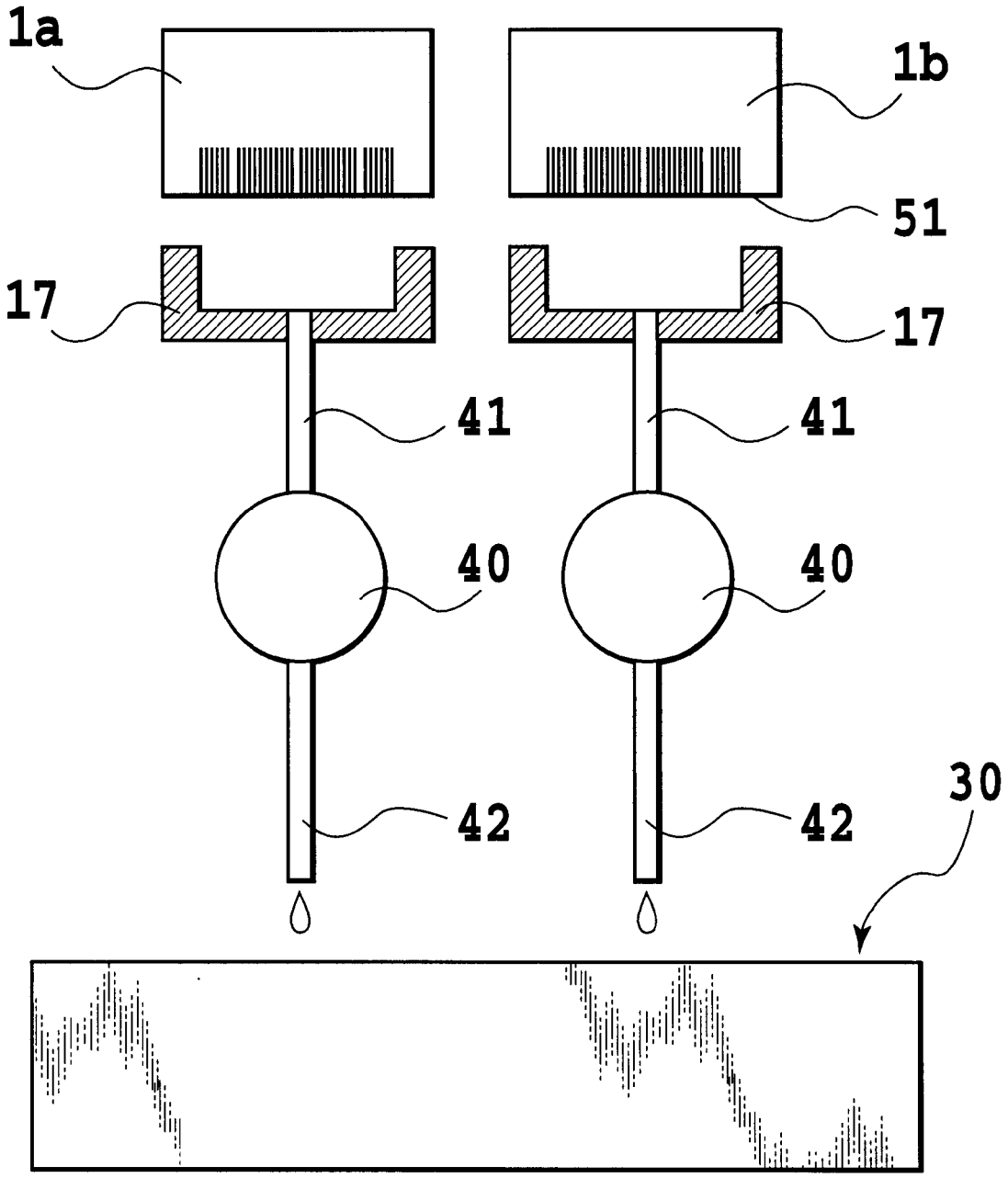
FIG. 6 is a diagrammatic view illustrating a constitution of a recovery device according to a second embodiment of the present invention.

FIG. 6 is a diagrammatic view of a constitution of a recovery device, illustrating a flow of the waste ink during the recovery operation of recording heads 1*a* and 1*b*.

While only one recording head 1 is carried on the carriage 2 in the above-mentioned first embodiment, two recording heads 1*a* and 1*b* are mounted to the carriage 2 in this embodiment. In the recovery device of this embodiment, a suction/recovery system is provided, wherein each of the recording heads 1*a* and 1*b* has an exclusive suction pump 40.

Figure 7A:
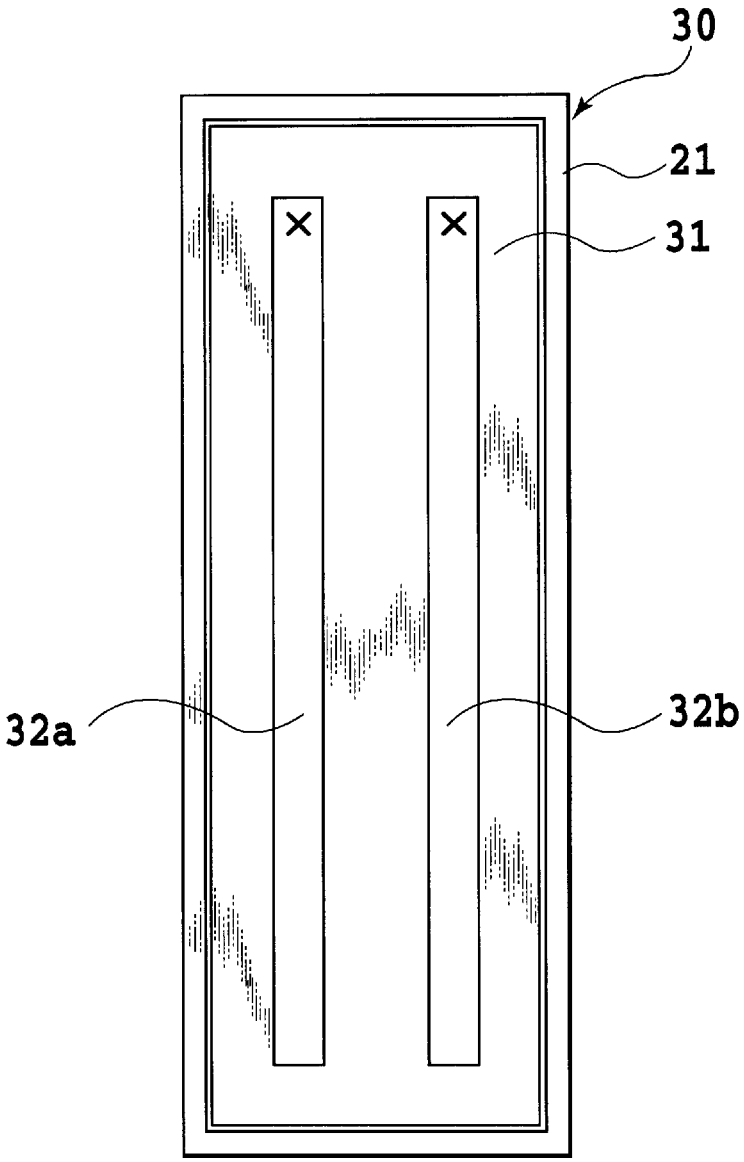
FIG. 7A is a plan view of a waste ink tank according to the second embodiment of the present invention.
Figure 7B:
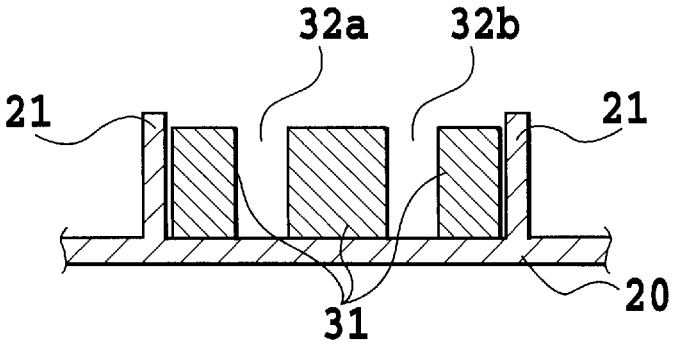
FIG. 7B is a sectional view of this waste ink tank.

FIG. 7A is a plan view of a waste ink tank according to the second embodiment of the present invention, and FIG. 7B is a sectional view thereof. The waste ink absorber 31 of this embodiment has two slits 32*a* and 32*b* so that the waste ink sucked from each of the two recording heads 1*a* and 1*b* is discharged to each of the two slit 32*a* or 32*b*, respectively. In such a manner, a plurality of slits may be provided in the waste ink absorber 31 in correspondence to a plurality of inlet positions to which the waste ink is introduced.

Third Embodiment

Figure 8A:
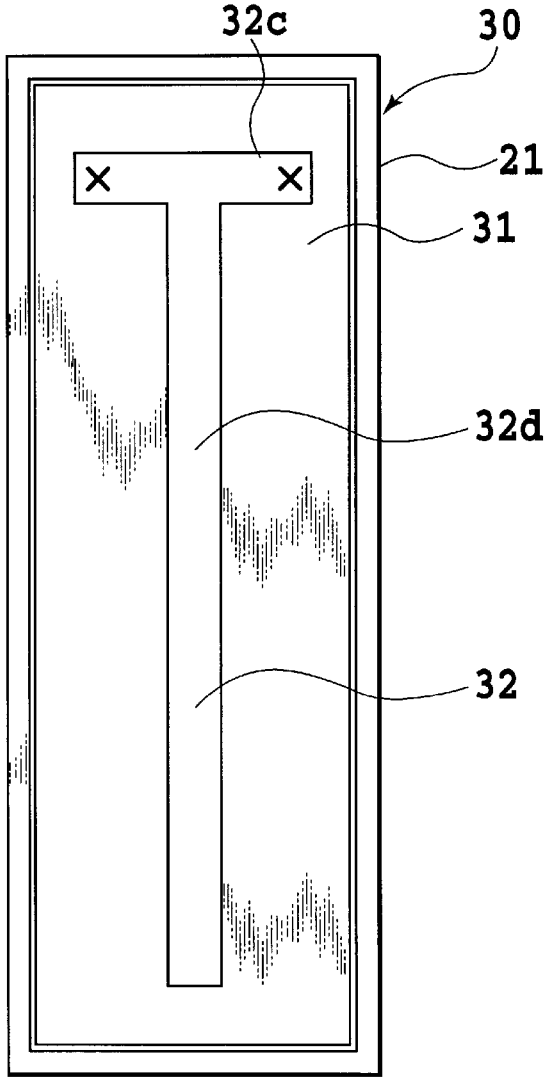
FIG. 8A is a plan view of a waste ink tank according to a third embodiment of the present invention.
Figure 8B:
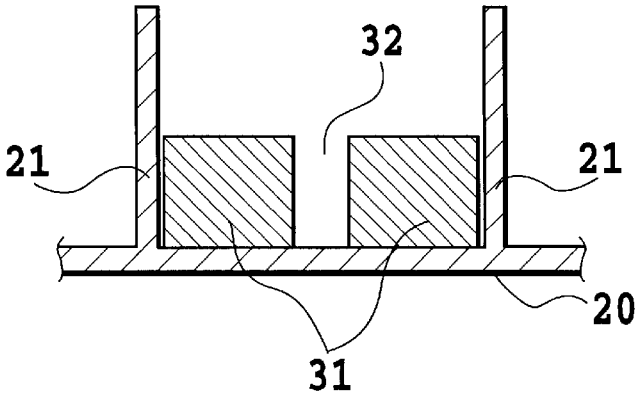
FIG. 8B is a sectional view of this waste ink tank.

FIG. 8A is a plan view of a waste ink tank according to a third embodiment of the present invention, and FIG. 8B is a sectional view thereof.

According to this embodiment, similar to the second embodiment described above, two recording heads 1*a* and 1*b* are mounted to the carriage 2 and a suction/recovery system is provided, wherein each of the recording heads 1*a* and 1*b* has an exclusive suction pump 40.

In this embodiment, a slit 32 of a waste ink absorber 31 is of a T-shape as seen in a plan view, and the waste ink sucked from each of the recording heads 1*a*, 1*b* is discharged to each of positions indicated by a cross mark. That is, the slit 32 in this embodiment is constituted by a slit section 32*c* connecting the respective cross-marked positions with each other and a slit section 32*d* branched from a midportion of the slit section 32*c* to form a continuous slit by the slit sections 32*c* and 32*d*. The slit 32 of this embodiment is different from that of the second embodiment in that the slit section 32*d* is commonly used, whereby a total length of the slit could be reduced. According to this embodiment, there is an advantage in that the reduction in volume of the waste ink absorber 31 due to the slit 32 is minimized.

A shape of the slit 32 is not limited to a mere straight line but may be curvilinear. If there are four inlet positions or more to which the waste ink is introduced, such inlet positions may be arranged, for example, at four corners of the ink tank and a plurality of slits extend therefrom to be concentrated to one point, for example, to form a cross pattern or the like.

Other Embodiments

In any of the preceding embodiments, a width of the slit is not specially limited. If the slit width is too small, however, there is a risk in that the slit itself may be clogged with thickened waste ink. Contrarily, if the slit width is too large, a volume of the absorber reduces by the slit to lower a capacity thereof for absorbing and retaining the waste ink, whereby the efficiency is deteriorated. Therefore, in the above-mentioned embodiments, the slit width is in a range from approximately 5 mm to 15 mm. However, the slit width may be freely changed in accordance with a size of the recording apparatus.

If a slit has a sufficient depth, the slit is not necessarily required to pass through the waste ink absorber as in the preceding embodiments. Also, the waste ink absorber may absorb not only waste ink sucked out of the recording head but also ink which is ejected or discharged with pressure from the recording head but not contributing to the image recording.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–700° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A waste ink tank having a waste ink absorber for absorbing and retaining waste ink introduced into a predetermined waste-ink inlet position, comprising:

a channel formed in the waste ink absorber, the channel extending along a bottom face of said waste ink tank from near one side of the waste ink tank to near another side of the waste ink tank to include the waste-ink inlet position, the channel leading to the bottom face of said waste ink tank, the bottom face being utilized to move the waste ink.

2. A waste ink tank as claimed in claim 1, wherein the channel is a slit formed on a surface of the waste ink absorber and extending from the waste-ink inlet position at least in one direction.

3. A waste ink tank as claimed in claim 1, wherein the channel is a slit passing through the waste ink absorber in a depth direction and extending from the waste-ink inlet position at least in one direction.

4. A waste ink tank as claimed in claim 1, wherein the channel is a slit, at least part of which extends in a rectilinear manner.

5. A waste ink tank as claimed in claim 1, wherein the channel is a slit, at least part of which extends in a curvilinear manner.

6. A waste ink tank as claimed in claim 1, wherein the waste-ink inlet position comprises a plurality of waste-ink inlet positions, and a plurality of channels are formed in correspondence to the plurality of waste-ink inlet positions.

7. A waste ink tank as claimed in claim 6, wherein the plurality of channels are slits extending generally parallel to each other.

8. A waste ink tank as claimed in claim 6, wherein the plurality of channels are slits at least partially continuous to each other.

9. A waste ink tank as claimed in claim 6, wherein the channel is formed of a first slit section connecting the plurality of waste-ink inlet positions to each other and a second slit section branched from a mid-portion of the first slit section.

10. A waste ink tank as claimed in claim 6, wherein the channel is formed of a plurality of slits extending from the plurality of waste-ink inlet positions, respectively, to concentrate to one point.

11. A waste ink tank as claimed in claim 1, wherein an opening of the channel, except for at least the waste-ink inlet position, is covered with another waste ink absorber capable of absorbing and retaining the waste ink therein.

12. A waste ink tank as claimed in claim 1, wherein the waste ink absorber is accommodated in a top-opening tank case.

13. An ink jet recording apparatus for recording an image on a print medium by using an inkjet recording head capable of ejecting ink droplets, the apparatus comprising:

a waste ink tank having a waste ink absorber for absorbing and retaining waste ink introduced into a predetermined waste-ink inlet position, wherein a channel is formed in the waste ink absorber, the channel extending along a bottom face of the waste ink tank from near one side of the waste ink tank to near another side of said waste ink tank to include the waste-ink inlet position and leading to the bottom face of said waste ink tank, the bottom face being utilized to move the waste ink; and a recovery means for sucking ink from the ink jet recording head and discharging the same as the waste ink into the waste ink tank.

14. An ink jet recording apparatus as claimed in claim 13, wherein the recovery means is provided with a suction pump for sucking ink from ink ejection orifices of the ink jet recording head.

15. An ink jet recording apparatus as claimed in claim 13, further comprising:

means for displacing the ink jet recording head in reciprocation in a primary scanning direction; and means for transporting the print medium in an auxiliary scanning direction transverse to the primary scanning direction.

16. An ink jet recording apparatus as claimed a claim 13, wherein the ink jet recording head has an electrothermal transducer for generating heat energy used for the ejection of ink.

* * * * *

UNITED STATES PATENT AND TRADEMARK OFFICE

CERTIFICATE OF CORRECTION

PATENT NO. : 6,375,305 B2
DATED : April 23, 2002
INVENTOR(S) : Sugimoto et al.

It is certified that error appears in the above-identified patent and that said Letters Patent is hereby corrected as shown below:

Title page,
Item [56], References Cited, FOREIGN PATENT DOCUMENTS,
"06-198913 5/1979" should read -- 06-198913 7/1994 --;
"03227658 10/1991" should read -- 03-227658 10/1991 --; and
"408238782 9/1996" should read -- 08-238782 9/1996 --.

Column 1,
Line 44, "the" should be deleted.

Column 10,
Line 24, "a" should read -- in --.

Signed and Sealed this

Twenty-first Day of January, 2003

JAMES E. ROGAN
*Director of the United States Patent and Trademark Office*